US009308578B2

(12) United States Patent
Smerecky et al.

(10) Patent No.: US 9,308,578 B2
(45) Date of Patent: Apr. 12, 2016

(54) SUBSURFACE CHILLS TO IMPROVE RAILCAR KNUCKLE FORMATION

(75) Inventors: Jerry R. Smerecky, Roselle, IL (US); F. Andrew Nibouar, Chicago, IL (US); Noland Brooks, Muskegon, MI (US); Nick Salamasick, Nunica, MI (US)

(73) Assignee: Bedloe Industries LLC, Wilmington, DE (US)

( * ) Notice: Subject to any disclaimer, the term of this patent is extended or adjusted under 35 U.S.C. 154(b) by 156 days.

(21) Appl. No.: 13/333,035

(22) Filed: Dec. 21, 2011

(65) Prior Publication Data

US 2013/0160961 A1 Jun. 27, 2013

(51) Int. Cl.

| | |
|---|---|
| ***B22C 9/02*** | (2006.01) |
| ***B22C 9/22*** | (2006.01) |
| ***B22D 15/00*** | (2006.01) |
| ***B61G 3/04*** | (2006.01) |
| ***B22D 25/02*** | (2006.01) |
| ***B22C 9/10*** | (2006.01) |

(52) U.S. Cl.

CPC ... *B22C 9/02* (2013.01); *B22C 9/10* (2013.01); *B22D 15/00* (2013.01); *B22D 25/02* (2013.01); *B61G 3/04* (2013.01)

(58) Field of Classification Search

None

See application file for complete search history.

(56) References Cited

U.S. PATENT DOCUMENTS

| | | | | |
|---|---|---|---|---|
| 4,724,888 | A * | 2/1988 | Buhler | 164/7.1 |
| 7,302,994 | B2 * | 12/2007 | Mautino et al. | 164/137 |
| 2002/0007931 | A1 | 1/2002 | Crafton et al. | |
| 2005/0184021 | A1 | 8/2005 | Mautino et al. | |
| 2007/0125510 | A1 | 6/2007 | Mautino et al. | |
| 2011/0168655 | A1 * | 7/2011 | Nibouar et al. | 213/100 R |
| 2012/0000877 | A1 | 1/2012 | Smith et al. | |

FOREIGN PATENT DOCUMENTS

| | | | |
|---|---|---|---|
| CN | 101326089 | A | 12/2008 |
| CN | 101 402 131 | A | 4/2009 |

(Continued)

OTHER PUBLICATIONS

Meredith, J.F., "Using chills to improve casting soundness", Metal Casting Technologies, Mar. 2009, p. 50-52.*

(Continued)

*Primary Examiner* — Kevin E Yoon
*Assistant Examiner* — Jacky Yuen
(74) *Attorney, Agent, or Firm* — Banner & Witcoff, Ltd.

(57) ABSTRACT

A method for manufacturing a railcar coupler knuckle includes, before casting, positioning an external chill within a cope mold portion and a drag mold portion offset from and adjacent internal walls of a pulling face and a throat of the cope and drag mold portions, thus producing a casting with reduced micro-shrinkage in at least the throat, a high-stress section of the casting. Use of subsurface chills produces an improved surface with fewer inclusions when compared to an equivalent surface produced in a process without use of a subsurface chill. The external chill may be a cone chill of a larger size to improve cooling and solidification at and below the surface. The external chill may also be a cylindrical and/or oblong chill with a tapered design that may correspond to the internal walls of the cope and drag mold portions between the pulling face and the throat.

16 Claims, 9 Drawing Sheets

(56) References Cited

FOREIGN PATENT DOCUMENTS

| | | | | |
|---|---|---|---|---|
| FR | 2679161 | A1 | * | 1/1993 |
| GB | 743 098 | A | | 1/1956 |
| GB | 2 292 899 | A | | 3/1996 |
| GB | 2 300 611 | A | | 11/1996 |
| JP | 60076251 | A | * | 4/1985 |
| JP | 01107957 | A | * | 4/1989 |
| JP | 08174142 | A | * | 7/1996 |
| JP | 09267153 | A | * | 10/1997 |
| WO | WO 2009/142748 | A1 | | 11/2009 |
| WO | WO 2009/142750 | A1 | | 11/2009 |
| WO | WO 2009/142757 | A1 | | 11/2009 |
| WO | WO 2011/082348 | A1 | | 7/2011 |

OTHER PUBLICATIONS

Translation of Kawaguchi et al (JP 01-107957 A).*
Schleg, Frederick P., "Technology of Metalcasting." 2003: American Foundry Society, Schaumburg, IL, pp. 269-273, and 323.
International Search Report and Written Opinion for International Application No. PCT/US2010/062574, dated May 30, 2011 (13 pages).
International Search Report and Written Opinion for International Application No. PCT/US2012/037980, dated Aug. 14, 2012 (11 pages).
International Search Report for International Application No. PCT/US2012/070012, dated Nov. 12, 2013, 4 pages.
Jun. 3, 2015—(CN) Office Action—App. 201280004711.5.

* cited by examiner

SUBSURFACE CHILLS TO IMPROVE RAILCAR KNUCKLE FORMATION

RELATED APPLICATION

This application is related to U.S. patent application Ser. No. 12/979,967 ("the '967 Application"), filed Dec. 28, 2010 and entitled "Knuckle Formed Through The Use of Improved External and Internal Sand Cores and Method of Manufacture," which is hereby incorporated by this reference in its entirety.

BACKGROUND

1. Technical Field

The present embodiments relate generally to the field of railroad couplers, and more specifically, to the casting of railcar coupler knuckles using subsurface chills to reduce micro-shrinkage in a high-stress area of the casting.

2. Related Art

Railcar couplers are disposed at each end of a railway car to enable joining one end of such railway car to an adjacently disposed end of another railway car. The engageable portion of each of these couplers is known in the railway art as a knuckle.

Typically, a knuckle is manufactured by a mold—usually made of sand—and several cores that are disposed within the mold. The mold shapes the outside of a casting. The cores are disposed to shape the inside or outside of a casting. Without the internal cores, the casting would be made of solid metal. The outside cores help shape the exterior of the casting. The internal cores commonly are referred to as a finger core in the front portion of the knuckle, a pivot pin core in the center of the knuckle, and a kidney core at the rear of a knuckle, and form the cavities in the knuckle upon casting.

During the casting process itself, the interrelationship of the mold and the internal cores make the difference in producing a satisfactory railway coupler knuckle. Many knuckles fail from internal and/or external inconsistencies in the metal throughout the thickness of the knuckle. If one or more cores move during the casting process, then some knuckle walls may end up thinner than others, resulting in offset loading and, in turn, in an increased failure risk during use of the knuckle.

The external features of a coupler knuckle should meet railroad industry standards both because of initial acceptance of the knuckle and for its successful performance in service. External features of a knuckle (7 in FIG. 3) that must be formed properly for successful knuckle performance in service include a pulling face contour (30 in FIG. 3) and a throat (42 in FIG. 3). The pulling faces of mating couplers contact each other when freight cars are coupled together and transmit the forces pulling the train. These pulling forces can be substantial. Moments of force from the pulling face converge on the throat, a part of the knuckle that often fails because of the amount of force and the thinning of the throat area between the surface and a C-10 pin hole (38 in FIG. 3). For this reason, railroad industry standards exist that specify the shape of the pulling face contour and recommended practices for forming the coupler. Inconsistent or out of tolerance pulling face contours can result in poor coupling/uncoupling performance of the coupler or in detrimental load paths for the pulling load. One patent that discusses the importance of the proper performance of the pulling face is U.S. Pat. No. 7,337,826 entitled "Railway Car Coupler Knuckle Having Improved Bearing Surface" (the '826 Patent). The '826 Patent describes techniques for casting a knuckle coupler with an enhanced bearing surface. The '826 Patent, however, does not address the imperfections that can form on or below the knuckle surface during casting.

Coupler knuckles are generally manufactured from cast steel or alloys. By way of example, when a molten metal is introduced into a mold during casting, it is prone to shrinking as it cools and solidifies. This is known as "shrinkage" or "micro-shrinkage" and occurs because most metals are less dense as a liquid than as a solid. Shrinkage may occur on the outside of the casting, the inside of the casting, or both. Shrinkage may lead to the knuckle forming shrinkage defects and/or solidification related defects, and/or even the formation of a void in certain portions of the knuckle. This could cause premature wear on the coupler to or result in premature fatigue and/or failure.

One technique used to overcome micro-shrinkage is the inclusion of risers (255 in FIG. 4) in the mold. The risers feed the volumes of the casting that are prone to shrinkage with additional casting material as the casting cools. However, once the knuckle is cast, the risers must be removed, typically by surface grinding. This may cause damage to the knuckle's surface and cause the knuckle to prematurely fatigue and/or fail. Moreover, risers and/or large ingates (256 in FIG. 4), e.g., material that connects the risers to the casting, are limited by location in their ability to provide for a uniform thickness throughout the casting, maintain precise part profile, and they lose their effectiveness in areas farther away from the riser. Other benefits and drawbacks of using riser systems are discussed in the '967 Application.

Internal and external metal chills have also been used to help remove heat from the poured metal in the location of the chill in order to promote and direct solidification and limit the amount of shrinkage in the vicinity of the small area in which they are located. Sometimes chills can alleviate the need to have as many risers or have ingates located as close to each other. However, there are some disadvantages relating to the use of chills including additional costs. Furthermore, the chills must usually be made of the same material as the casting and sometimes fail to fuse with the casting, or must be removed from the cast knuckle later. External chills become attached to the knuckle surface and require removal followed by extra finishing steps that not only increase costs but can leave scars or defects on the surface of the knuckle casting. Use of chills takes much experimentation, and therefore failure, before finding a solution with improved results that justify the added cost and/or casting defects in certain parts of the knuckle casting. What is needed, therefore, is an improved chill and deployment thereof to obtain the benefits of using chills without the above-listed disadvantages.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION

Figure 1:
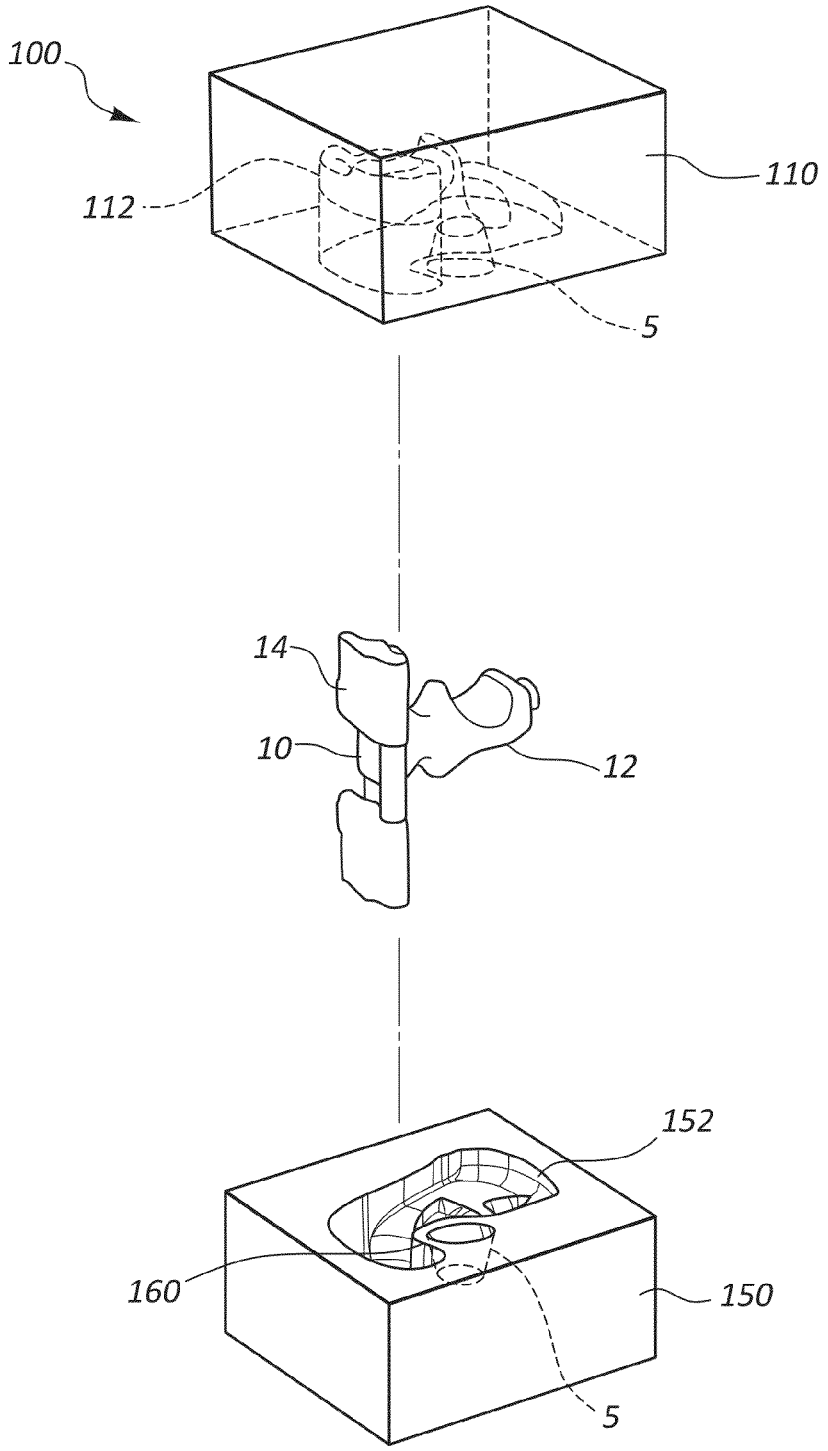
FIG. 1 is a schematic illustration of a coupler knuckle manufacturing assembly that includes use of an opening for an external subsurface chill (such as a cone chill) in the cope and the drag mold sections of the assembly.

In some cases, well known structures, materials, or operations are not shown or described in detail. Furthermore, the described features, structures, or characteristics may be combined in any suitable manner in one or more embodiments. It will also be readily understood that the components of the embodiments as generally described and illustrated in the Figures herein could be arranged and designed in a wide variety of different configurations.

As discussed above, one technique used to address micro-shrinkage issues is the addition of metal chills. Chills absorb and remove the heat from the poured metal in the location of the chill in order to promote (and direct) solidification and limit the amount of shrinkage in the vicinity of the small area in which they are located. These may be external chills, which may be placed along the mold walls at predetermined locations, or may be internal chills. Both external and internal chills will be discussed briefly, and then the remainder of the disclosure will focus on a particular type of external chill not before used in knuckle manufacturing.

Internal chills can be pieces of metal that are strategically placed inside the mold cavity and ultimately become part of the casting. Internal chills add cost because they must be made of the same material, or at least compatible, with the casting. Moreover, internal chills may not fuse properly with the casting, thus causing premature failure or requiring the casting to undergo a further finishing and/or repair process.

External chills, which become attached to a knuckle's surface, may leave scars or other defects on the surface that require the casted knuckle to undergo extra finishing operations such as grinding, which may adversely affect the knuckle's surface finish and increase the costs due to extra labor required. Due to manual application of external chills, external chills can result in inconsistent quality or a variance in tolerance of surface finish or dimensions within the foundry. Sometimes personnel inadvertently neglect the installations of chills or place them in the incorrect location. Moreover, chills must be clean and free of rust or other impurities so as not to inhibit the solidification process.

Accordingly, disclosed herein is a process to use a subsurface, external chill that is not attached, and therefore need not be removed from the surface of the knuckle. Through extensive research and trial, a subsurface cone chill of a general shape and size was determined to be the most effective at removing heat from the molten metal during casting in relation to improving the formation of the pulling surface of the knuckle. Variances in the cone chill will be apparent to one of skill in the art that would achieve the same or similar benefits. For instance, the cone chill may be truncated or pointed at the top, although the truncated feature helps to hold the chill in place vertically in a sand mold. Furthermore, an oblong and/or cylindrical chill that follows the contour of a wall between a pulling face and as far back as a locking face of the knuckle may provide similar beneficial results. More than one chill may also be used in various embodiments along this surface area of the knuckle casting.

Figure 2:
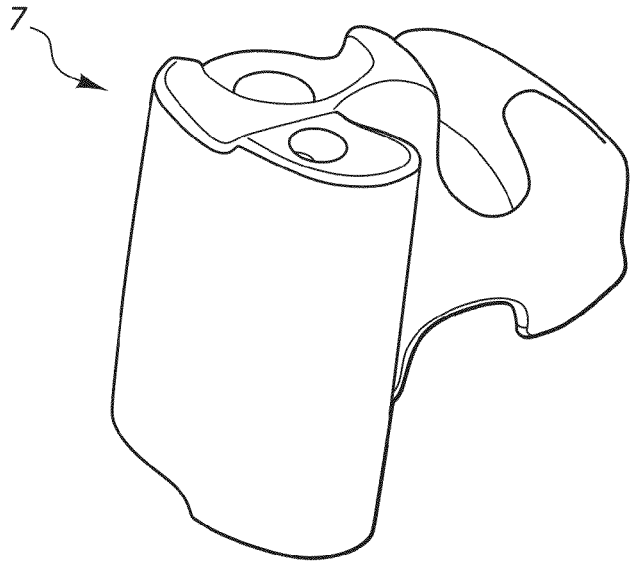
FIG. 2 is a perspective view of an example knuckle formed from the knuckle manufacturing assembly of FIG. 1.
Figure 3:
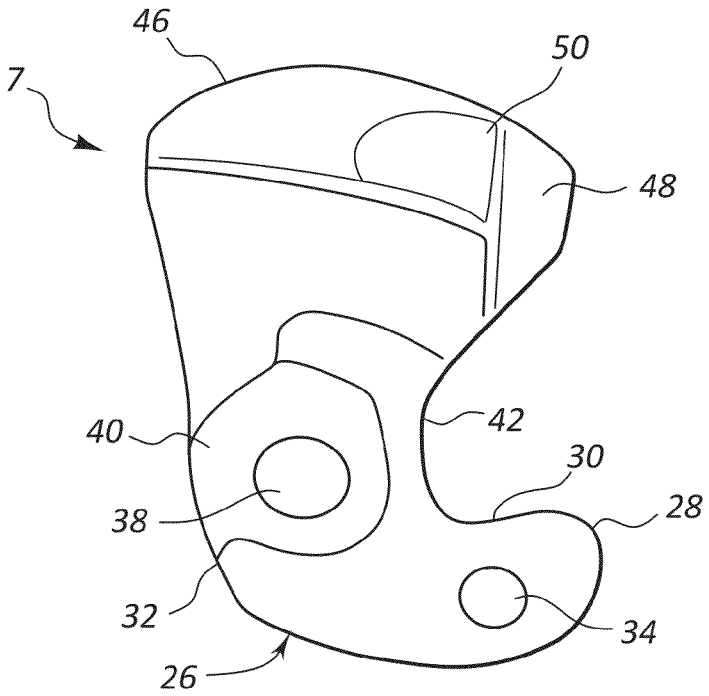
FIG. 3 is a top plan view of the knuckle of FIG. 2.

FIG. 1 is a schematic illustration of a coupler knuckle manufacturing assembly 100 that includes use of an external, subsurface chill 5 in the cope and the drag sections of the assembly. The knuckle manufacturing assembly 100 includes a cope mold section 110, a combined (or separate) pivot pin and kidney core 10 and 12 and a finger core 14 used in the manufacturing process and a drag mold section 150. The cope mold section 110 and the drag mold section 150 include mold cavities 112 and 152, respectively, into which a molten alloy is poured to cast a coupler knuckle (FIGS. 2-3). Mold cavities 112 and 152 are configured to correspond to the desired external surfaces of the coupler knuckle to be manufactured using cope and drag mold sections 110 and 150. The pivot pin and kidney cores 10 and 12 may be positioned within the cope or drag mold such as to be isolated from or connected with the finger core 14.

A completed knuckle 7 is shown in FIGS. 2-3. The finger core 14 forms the internal surfaces of a front face 26, nose 28, pulling face 30, heel 32 and flag hole 34 of the knuckle 7. The finger core 14 extends outward from the center to produce the flag hole 34 on both the top and bottom of the nose 28. The pivot pin core 10 forms the central internal surfaces, including the C-10 pin hole 38, hub 40 and throat 42. The kidney core 12 forms the internal surfaces of a tail 46 of the knuckle 7. The cope and drag mold portions further define perimeter boundaries of the outer surfaces of the knuckle 7, including but not limited to those of the nose 28, the tail 46, a lock shelf 48, a locking face 50 and the throat 42.

Figure 4:
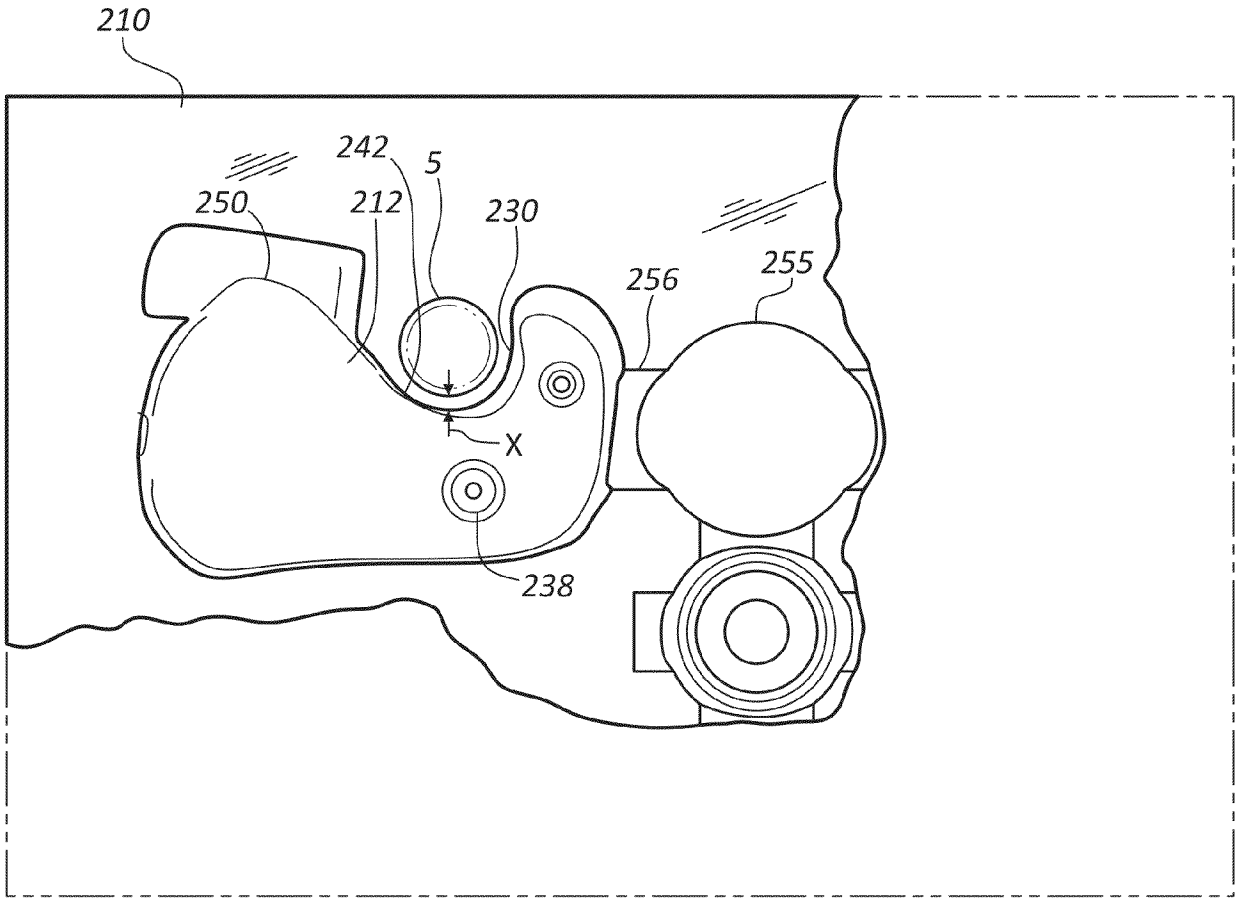
FIG. 4 is a plan view of a sand mold for casting multiple knuckles, the mold for each of the knuckles including an external subsurface chill.
Figure 8:
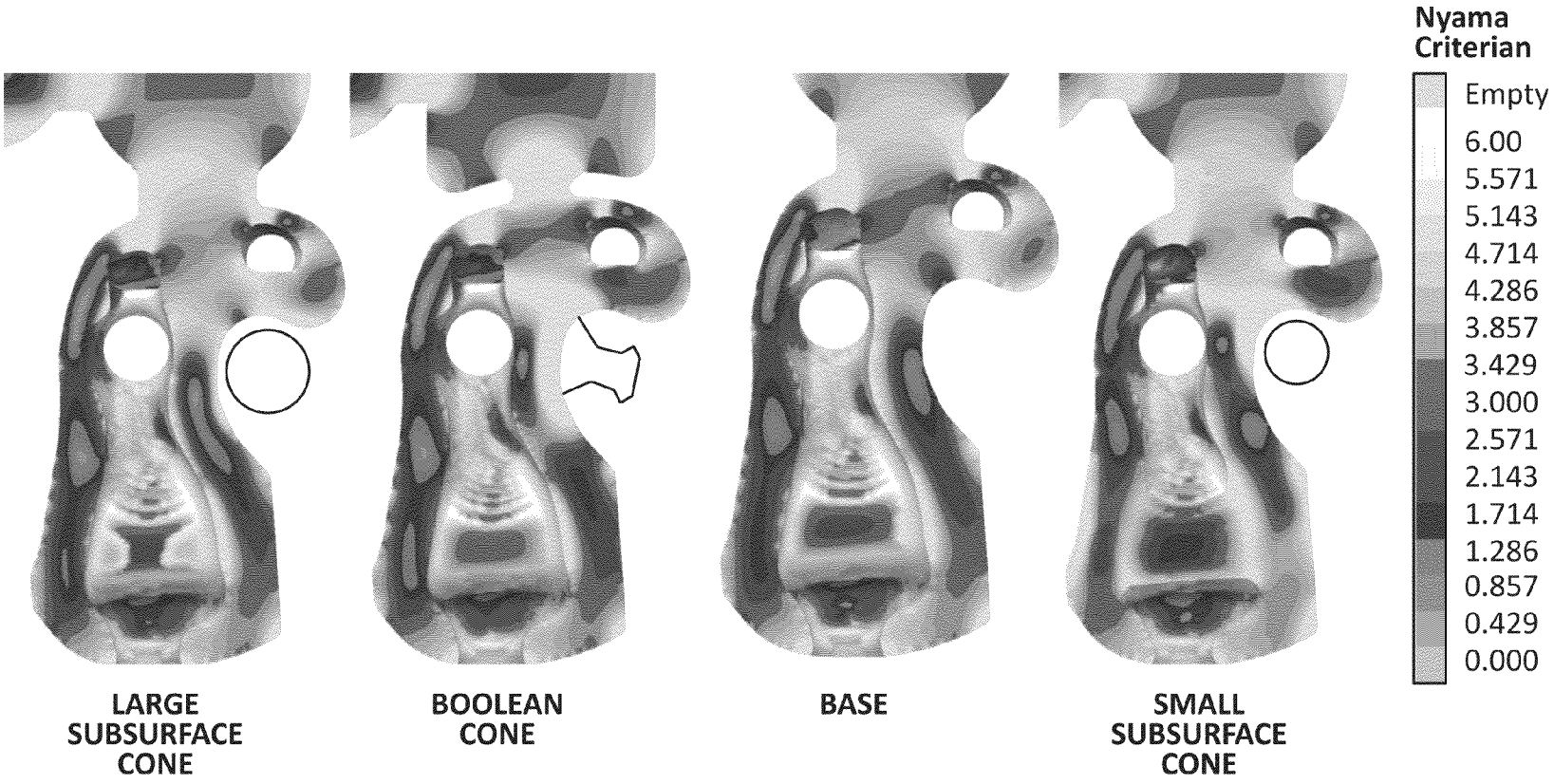
FIG. 8 is four screenshots of simulation results provided by a computer that tracks different regions of the coupler knuckle as the molten metal cools during the casting process using different external chills.

FIG. 4 shows use of the external, subsurface chill 5 in a cope mold 212 configured to cast multiple knuckles simultaneously. As will be explained in more detail, the chill 5 may be positioned offset from but near the internal walls of each mold cavity near the C-10 pin hole 238, to thereby affect the solidification of the molten metal at and below the surface of each coupler knuckle 7 generally between the pulling face 230 and the locking face 250. As will be made apparent, when "surface" is referred to herein with reference to improved solidification of the knuckle, "sub-surface" is included in the meaning of "surface" because the solidification is affected at and below the surface. The extent to which the subsurface region is affected by a chill depends on the size, shape and positioning of the chill (FIG. 8). The larger and closer the sub-surface chill 5 is to a surface, the more subsurface area of the casting will be cooled and receive directional solidification, and thus reduced micro-shrinkage. Directional solidification describes solidification that occurs from the farthest end of a casting and works its way towards the sprue entrance, where metal flows into the mold. The subsurface chill 5 may likewise be included in a corresponding drag mold section (not shown) for the coupler knuckle(s) 7.

The subsurface chill 5 may be of different sizes and shapes, some functioning better than others to cool the throat 42 of the coupler knuckle 7 as it is cast. From dynamic testing results and review of sectioned castings using fracture analysis of failed surfaces, it was determined that the throat 42 of the knuckle 7 was particularly subject to poor performance due to micro-shrinkage. Micro-shrinkage shortens the life of the knuckle significantly because the throat 42 is subjected to high cyclic stresses. By placing a chill near the C-10 pin hole location 238 of the knuckle within the cope and drag molds 110 and 150, the inventors achieved significant reductions in micro-shrinkage and the little micro-shrinkage that remained was forced into less important areas of the cast knuckle. Furthermore, there were much fewer surface inclusions, leaving an improved, smoother finish along the surface between at least the pulling face 30 and the throat 42 of the knuckle 7 when compared to an equivalent surface in a process without the use of subsurface chills.

The subsurface chill 5 is positioned near to but not touching the surface of the casting, leaving a small gap of sand therebetween and thus obviating the need to remove the subsurface chill from the knuckle after casting. The result of using a subsurface chill is preservation of the cast surface and precise dimensions of the cast knuckle. Through the testing process, the design team determined that a much larger subsurface chill 5 than previously tested in experiments, together with correct positioning, produced a greater reduction in micro-shrinkage in the surface areas generally adjacent the C-10 pin hole 238 of the casting, including in the throat 42. While the micro-shrinkage was not always completely eliminated, it was reduced sufficiently to pass intense dynamic testing or was moved away from the high stress surfaces (e.g., the throat and pulling face surfaces). Table I below summarizes results of dynamic testing with various surface and subsurface chills.

TABLE I

| Chill Description | Location | Result |
|---|---|---|
| Rectangular Block Chill | Subsurface | Little difference in removing micro-shrinkage |
| Small Truncated Cone Chill | Subsurface | Little difference in removing micro-shrinkage |
| Small Truncated Cone Chill | Surface (Prior Art Method) | Removed micro-shrinkage significantly; surface rough with inclusions |
| Boolean Chill | Surface (Prior Art Method) | Removed micro-shrinkage significantly; surface rough with inclusions |
| Large Truncated Cone Chill | Subsurface | Removed micro-shrinkage significantly; few surface inclusions |

Figure 5C:
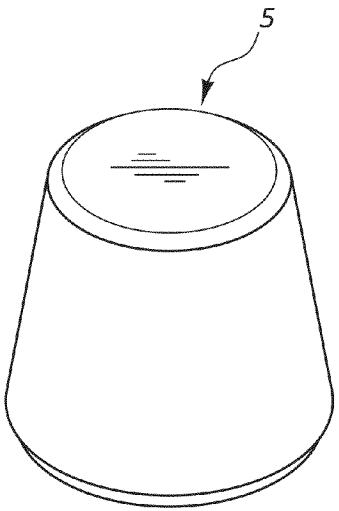
FIGS. 5A through 5C is an embodiment of the cone chill shown in FIG. 1 and relative dimensions of the cone chill.
Figure 5A:
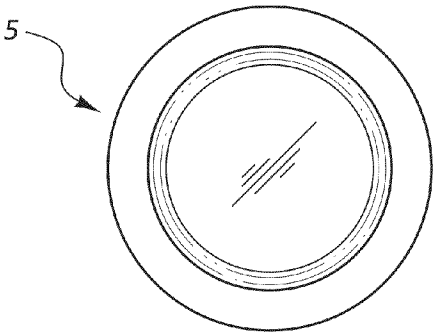
Figure 5B:
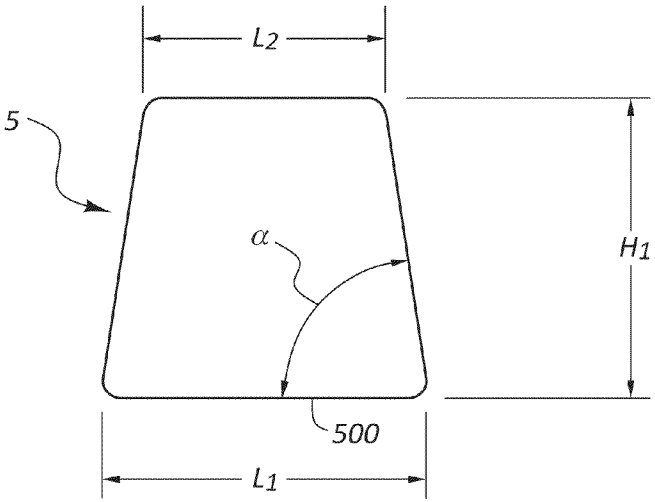

The external chill finally selected as most effective was the large truncated cone chill used as a subsurface chill. In one embodiment (shown in FIGS. 5A through 5C), the large cone chill includes a major diameter ($L_1$) of at least approximately 2.7", which may also be a mounting surface 500, a minor diameter ($L_2$) of at least approximately 2.0" and a height ($H_1$) of at least approximately 2.5". The angle $\alpha$ may be about 75 to 85 degrees, for instance, about 81 degrees. This cone chill has an approximate surface area of 28 $in^2$, an approximate volume of 11 $in^3$ and an approximate mass of 3.2 lbs. In other embodiments, each of the above-recited dimensions may be increased or decreased by anywhere between about 0.2" to 0.7". Accordingly, the volume may be larger than about 10 $in^3$ and the surface area of the mounting surface 500 may be larger than about 4 $in^2$. The chill may be placed between ⅛" and 3/16" offset from the surface of the casting at the closest point(s), such as shown as distance X in FIG. 4. Greater distances may be used with varying degrees of success depending on the size of the subsurface chill. This creates a wall of sand between the subsurface chill and the casting of at least ⅛" in thickness. If the wall of sand gets too thin, it could break and holes can form through which molten metal may attach the chill 5 to the casting surface. If the chill is too far away from the casting surface, the beneficial thermodynamic effects of the chill may not be realized.

The subsurface cone chill 5 may be made from a variety of materials, including but not limited to a variety of commercial grade steels. While other materials could be selected from which to make the chills such as copper-beryllium, cast steel of general chemistries was chosen as it was inexpensive for the foundry to acquire, is effective in chilling and does not require special segregation during use. The subsurface chills 5 disclosed herein may also be made from cast gray iron or a combination of gray iron and graphite flakes since the thermal conductivity of cast gray iron is primarily a function of the graphite flake content.

External chills or chill cores may also be made of non-metallic material with varying degrees of success. For instance, the subsurface chill 5 may be made of silicon carbide or graphite or at least portions of the chill 5 may be made from high-density sands such as zircon or chromite or their respective derivatives. Graphite is desirable because it provides higher cooling rates due to its high levels of thermal conductivity. Using a non-metallic or mostly non-metallic chill may also be beneficial if the wall of sand does break because it won't attach to the knuckle casting and surface grinding can be avoided or minimized.

Figure 6:
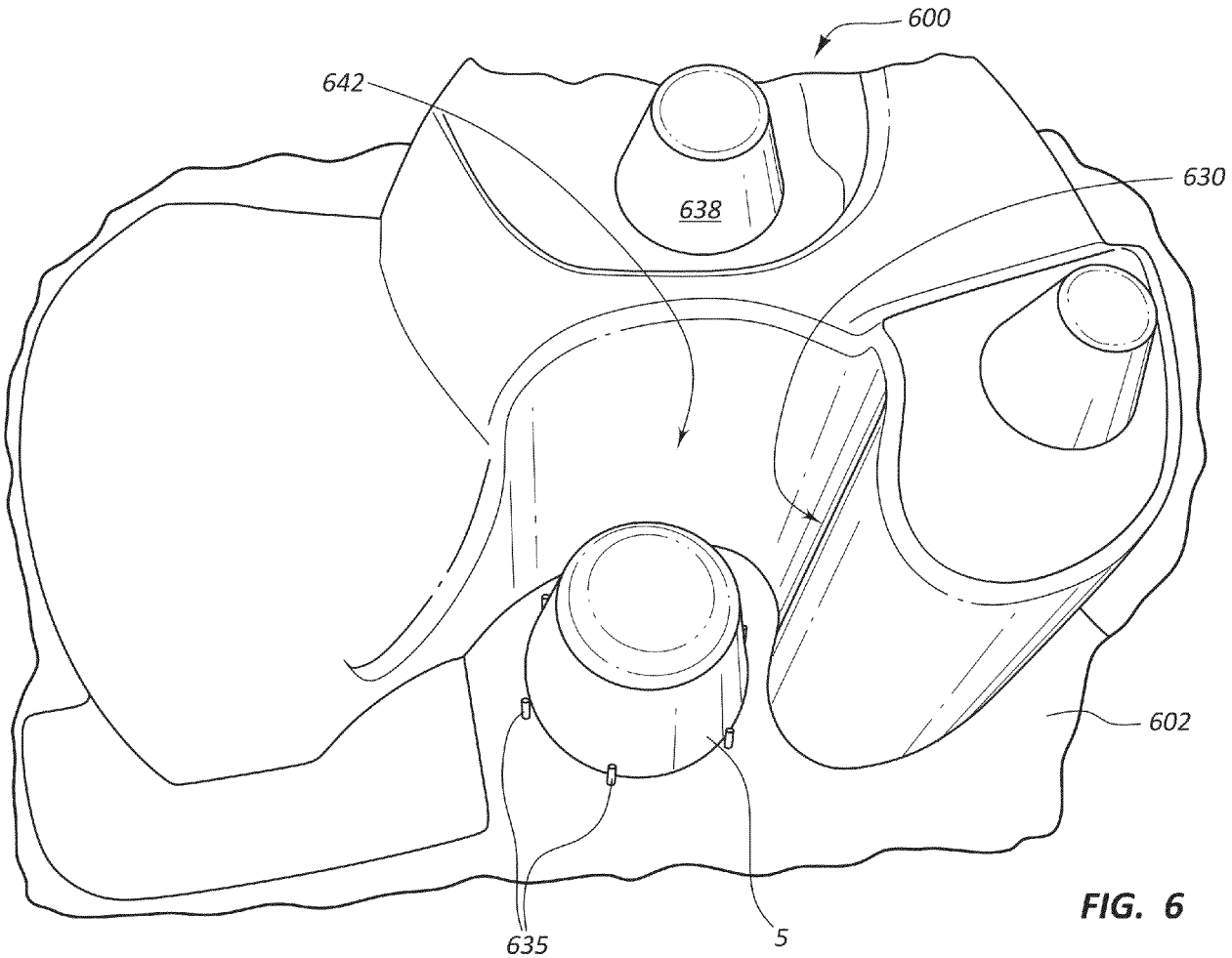
FIG. 6 is a pattern for creating the cope mold displayed in FIG. 1, including mounting the cone chill on a pattern plate near the pulling face and throat portions of the coupler knuckle pattern.
Figure 7:
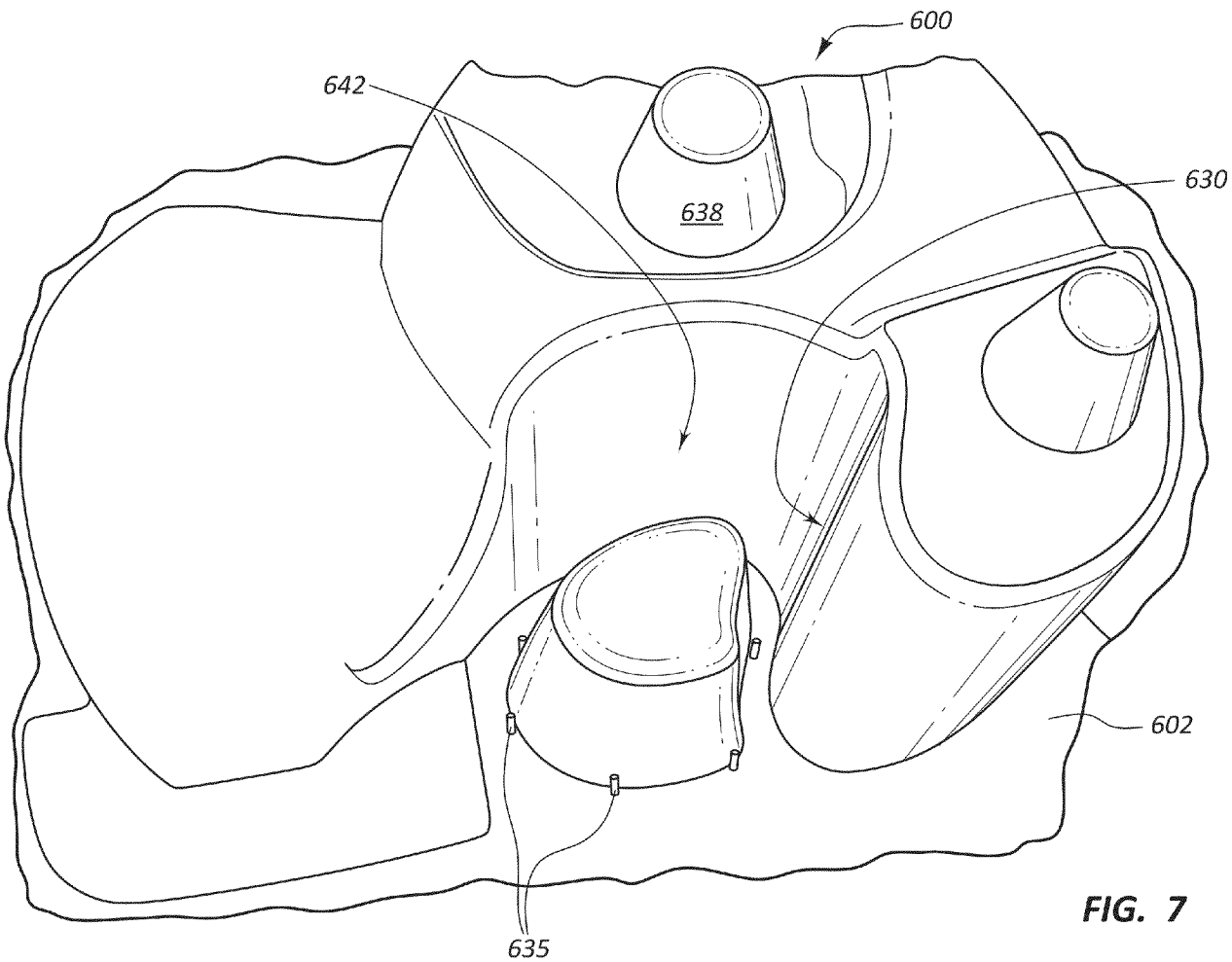
FIG. 7 is a pattern for creating the cope mold displayed in FIG. 1, including mounting an oblong-shaped chill on the pattern plate, the oblong-shaped chill corresponding to a surface between the pulling face and throat portions of the coupler knuckle pattern.

FIGS. 6 and 7 show a coupler knuckle pattern 600 attached to a pattern plate 602 for creating the cope mold 110 displayed in FIG. 1. Each pattern 600 is mounted to a pattern plate 602 to stabilize the pattern within a mold box, and to create the mold cavity 112 or 152 within the cope or drag mold section 110 or 150 used to cast the knuckle(s) 7. The cone chill 5 of FIG. 6 may be mounted on the pattern plate 602 adjacent to and offset from a surface of the pattern near a C-10 pin hole 638 of the coupler knuckle pattern 600. The oblong, generally cylindrical chill 5 of FIG. 7 may likewise be mounted on the pattern plate 602. The chills are also positioned near the pulling face 630 and the throat 642 regions of the pattern 600, and may, as in FIG. 7, be tapered and/or shaped such as to correspond to the contour of these regions. These chills 5 may include more than one chill in alternative embodiments.

The chills 5 are held horizontally in the location of mounting by the use of small, vertical pins 635 set in the pattern plate on the perimeter of the major diameter of the chill 5. The pins may be quite small, from approximately 1/16" to ⅛" in diameter and about ¼" to 1" high. Sand under the circumferential radius of the major diameter of the cone chills may secure the cone chills vertically. Other ways of mounting the chill 5 to the pattern plate 602 are envisioned, for instance with the use of a dowel or rod (not shown) and a corresponding channel for receipt of the dowel or rod (not shown). Sand is packed into and around the pattern 600 within a cope or drag mold box 110 or 150, including the subsurface chill 5, to form the mold cavity 112 for the upper section 120 of the knuckle 7. The drag mold section 150 may be similarly prepared. Each subsurface chill 5 may then be released from the pins 635 (or dowels or rods) when each pattern 600 is removed from the molds, leaving the subsurface chills 5 in each respective mold while it cures, after which the molds are prepared for casting.

Because the chill is mounted on the pattern plate 602, when the pattern 600 is removed, the chill is exposed at the surface. Accordingly, when the cope mold section 110 is closed on top of the drag mold section 150, the chills from each section 110 and 150 may come into contact with each other, making an effective chill of twice the size, thus improving the cooling affects provided to the casting surface. In addition, or alternatively, the chills may be aligned with and adjacent each other, whether or not they come into contact.

FIG. 8 includes four screenshots of simulation results provided by a computer program that tracks different regions of the coupler knuckle as the molten metal cools during the casting process using different chills 5. The "Base" screenshot indicates a baseline in which no chill was used, for comparison with those examples that use a chill. The darker areas in the screenshots are more likely to have defects. The Boolean Cone and Small Subsurface Cone examples include significantly more dark areas near the pulling surface of the knuckle when compared with that of the Large Subsurface Cone, confirming the improvement through the use of the large cone chill 5.

The chilling effect of the subsurface cone chill 5 was simulated using Magma5 from Magmasoft®. Not only did the simulation help in the analysis by defining the problem area around the throat 42 and the throat surface, the software was also useful in developing the appropriate size, location and shape of the chill without having to run multiple actual test runs in the foundry. Multiple simulations were made using various sizes and shapes for the chill. The subsurface cone chill 5 of the above sizes and shapes were selected as being just large enough to move the micro-shrinkage away from the surface without completely freezing off the directional solidification in the casting as larger chills might have done. Results of using the oblong, cylindrical chill 5 of FIG. 7 are not shown in FIG. 8, but are at least at beneficial as with the large subsurface chill. As can be seen, the larger subsurface chill 5 improved solidification and included substantially fewer defects between the pulling face and the lock shelf 48 of the coupler knuckle, including the throat 42 that lies therebetween.

Figure 9:
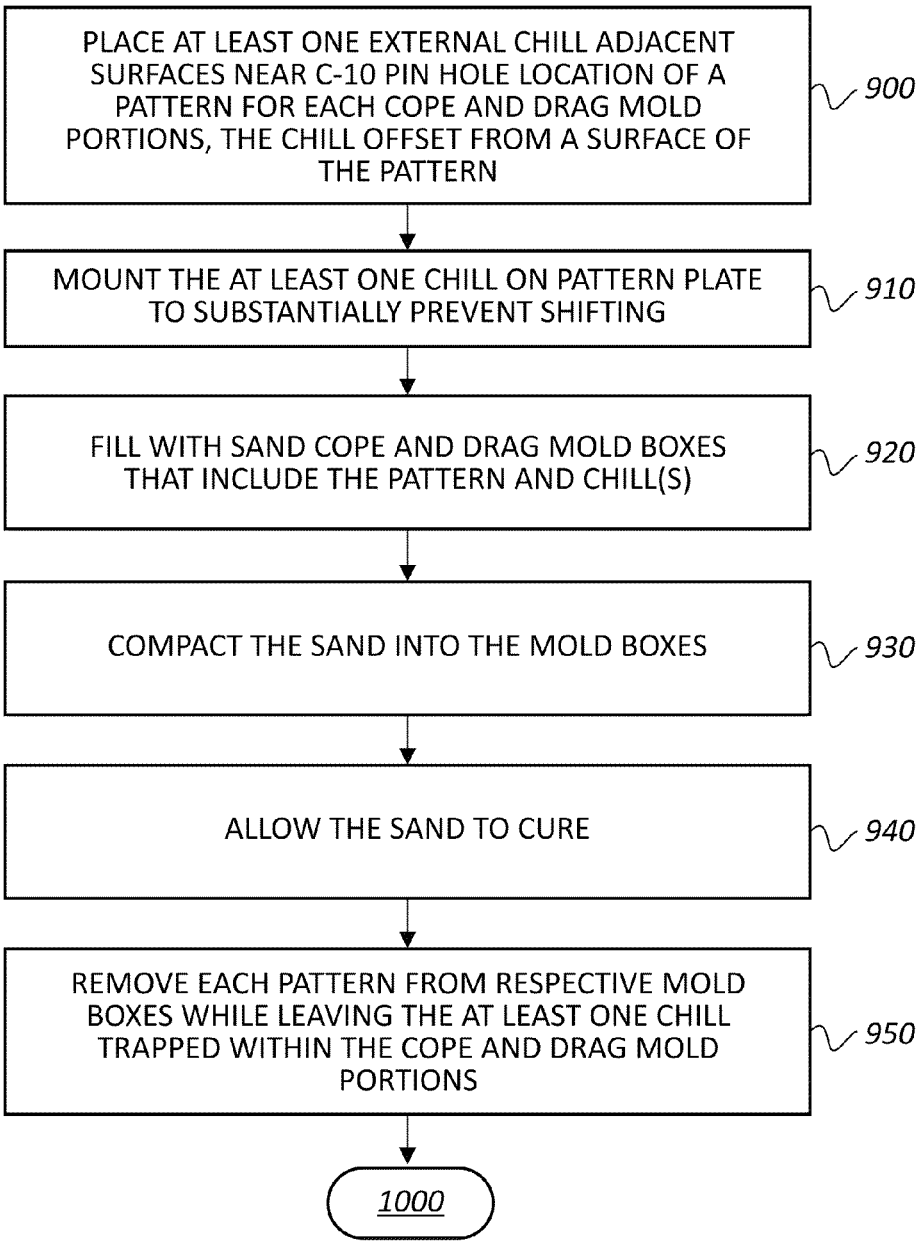
FIG. 9 is a flow chart of an exemplary method for forming cope and drag mold portions including external subsurface chills for casting a railcar coupler knuckle.

FIG. 9 is a flow chart of an exemplary method for forming cope and drag mold portions including external subsurface chills for casting a railcar coupler. The method includes, at block 900, placing at least one external subsurface chill near a surface of a pattern for each mold portion between a pulling face and a throat of the pattern, the at least one chill offset from and adjacent to a surface near a C-10 pin hole of each pattern. The method may further include, at block 910, mounting the at least one chill to a plate of each pattern to substantially prevent shifting. The method also includes, at block 920, filling cope and drag mold boxes with sand, the mold boxes including respective patterns and the mounted at least one chill, where each at least one chill is trapped within respective cope and drag mold portions with at least a thin wall of sand between the at least one chill and internal walls of the cope and drag mold portions defining the surface between the pulling face and the throat. The method may further include, at block 930, compacting the sand into the mold boxes. The method may further include, at block 940, allowing the sand to cure. The method further includes, at block 950, removing each pattern from respective mold boxes while leaving the at least one chill trapped within the cope and drag mold portions.

Figure 10:
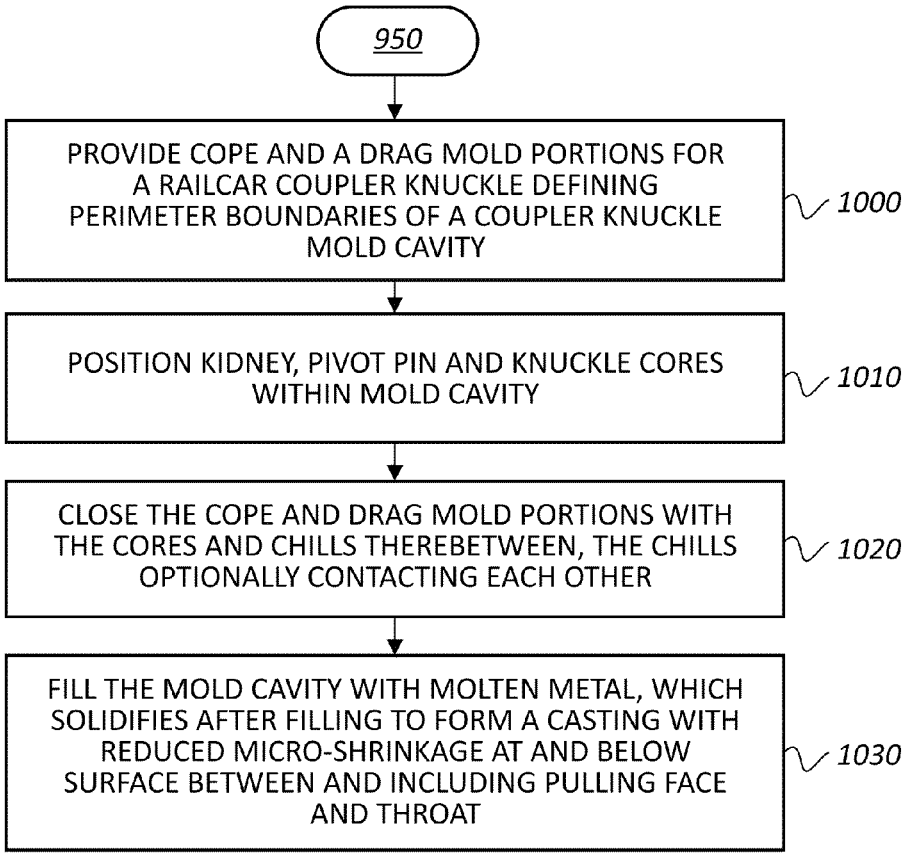
FIG. 10 is a flow chart of an exemplary method for manufacturing a railcar coupler knuckle using external subsurface chills.

FIG. 10 is a flow chart of an exemplary method for manufacturing a railcar coupler knuckle using external subsurface chills as continued from FIG. 9. The method includes, at block 1000, providing a cope mold portion and a drag mold portion, the cope and drag mold portions having internal walls defining at least in part perimeter boundaries of a coupler knuckle mold cavity. The method further includes, at block 1010, positioning the kidney, pivot pin and/or knuckle cores within cavities of the cope and/or drag mold portions, as required. The method further includes, at block 1020, closing the cope and drag mold portions with the cores and chills therebetween, the chills in the cope and drag mold portions optionally contacting each other across a centerline of the mold cavity, which may double the size of the effective chill and its impact on cooling. The method further includes, at block 1030, filling the mold cavity with a molten metal, the molten metal solidifying after filling to form a casting with reduced micro-shrinkage at and below the surface between and including the throat and/or pulling face of the knuckle. The chills may be large cone chills, oblong or cylindrical cones, or other chills. One longer chill may also be used that spans the cope and drag mold sections 112 and 152 instead of two separate chills 5.

The terms and descriptions used herein are set forth by way of illustration only and are not meant as limitations. Those skilled in the art will recognize that many variations can be made to the details of the above-described embodiments without departing from the underlying principles of the disclosed embodiments. For example, the steps of the methods need not be executed in a certain order, unless specified, although they may have been presented in that order in the disclosure. The scope of the invention should, therefore, be determined only by the following claims (and their equivalents) in which all terms are to be understood in their broadest reasonable sense unless otherwise indicated.

The invention claimed is:

1. An assembly for casting a light steel railcar coupler knuckle, comprising:

a cope mold portion, the cope portion having internal walls defining at least in part perimeter boundaries of a coupler knuckle mold cavity including a front face portion, a nose portion, a pulling face portion, a heel portion, a throat portion, a tail portion, a lock shelf portion, and a locking face portion;

a drag mold portion, the drag mold portion having internal walls defining at least in part perimeter boundaries of a coupler knuckle mold cavity including a front face portion, a nose portion, a pulling face portion, a heel portion, a throat portion, a tail portion, a lock shelf portion, and a locking face portion;

at least one riser preceding and engaged with at least one ingate in the front face portion;

at least one internal core placed to define within the coupler knuckle a finger cavity, a pivot pin cavity forming a C-10 pin hole, and a kidney cavity;

a first subsurface external chill positioned within the cope mold portion, the first chill positioned between the front face portion and the tail portion of the cope and drag mold portions and adjacent to the throat portion and the C-10 pin hole, the first chill offset at least ⅛" from and adjacent the internal walls of the pulling face and the throat of the cope mold portion, where a wall of sand exists between the first chill and the internal walls of the coupler knuckle mold cavity;

a second subsurface external chill positioned within the drag mold portion, the second chill positioned between the front face portion and the tail portion of the cope and drag mold portions and adjacent to the throat portion and the C-10 pin hole, the second chill offset at least ⅛" from and adjacent the internal walls of the pulling face and the throat of the drag mold portion, where a wall of sand exists between the first chill and the internal walls of the coupler knuckle mold cavity;

wherein the first and second chills are positioned within each of the cope and drag mold portions such that the chills contact each other along a centerline of the casting after the cope and drag mold portions are closed prior to casting;

wherein a coupler knuckle is formable of metal from the cope and drag mold portions that include the chills, the coupler knuckle including an improved surface with reduced subsurface micro-shrinkage at a location of at least the throat of the coupler knuckle as compared to an equivalent surface cast in a process using a surface chill; and wherein the improved surface extends substantially between the pulling face and lock shelf of the coupler knuckle.

2. The assembly of claim 1, wherein the at least one internal core comprises two internal cores, a first internal core placed to define within the coupler knuckle a finger cavity and a second internal core placed to define within the coupler knuckle a pivot pin cavity and a kidney cavity.

3. The assembly of claim 2, wherein the first and second chills are each cone shaped.

4. The assembly of claim 3, wherein the first and second chills are each truncated cones including dimensions of a major diameter of more than 2.0", a minor diameter of more than 1.50" and a height of more than 1.85".

5. The assembly of claim 4, wherein the first and second chills each comprise a volume of at least ten cubic inches.

6. The assembly of claim 5, where the first and second chills each comprise a maximum cross section of about four square inches.

7. The assembly of claim 6, wherein the first and second chills each comprise a mass of at least 3 pounds.

8. An assembly for creating a mold for casting a light steel railcar coupler knuckle, comprising:

a first pattern plate;

a second pattern plate;

a first pattern half attachable to the first pattern plate with which to form a cope mold portion, the first pattern half having exterior walls defining in the cope mold portion at least in part perimeter boundaries of a coupler knuckle mold cavity including a front face portion, a nose portion, a pulling face portion, a heel portion, a throat portion, a tail portion, a lock shelf portion, and a locking face portion;

a second pattern half attachable to the second pattern plate with which to form a drag mold portion, the second pattern half having exterior walls defining in the drag mold portion at least in part perimeter boundaries of a coupler knuckle mold cavity including a front face portion, a nose portion, a pulling face portion, a heel portion, a throat portion, a tail portion, a lock shelf portion, and a locking face portion;

at least one riser preceding and engaged with at least one ingate in the front face portion;

a first subsurface external chill releasably attached to the first pattern plate positioned between the front face portion and the tail portion of the first pattern plate and adjacent to the throat portion and a C-10 pin hole, the first chill offset at least ⅛" from and adjacent a throat region of respective pattern halves, wherein the first chill is configured to remain trapped within the cope mold portion when the first pattern half is removed from the cope mold portion;

a second subsurface external chill releasably attached to the second pattern plate positioned between the front face portion and the tail portion of the second pattern plate and adjacent to the throat portion and the C-10 pin hole, the second chill offset at least ⅛" from and adjacent a throat region of respective pattern halves, wherein the second chill is configured to remain trapped within the drag mold portion when the second pattern half is removed from the drag mold portion; and wherein the first and second chills are attached to the first and second pattern plates such that the chills contact each other along a centerline of the casting after the cope and drag mold portions are closed prior to casting.

9. The assembly of claim 8, wherein the first chill is releasably attached to the first pattern plate with a plurality of vertical pins and wherein the second chill is releasably attached to the second pattern plate with a plurality of vertical pins.

10. The assembly of claim 9, wherein the first and second chills each include a larger cross sectional area on a side that is mounted to the pattern plates than the cross sectional area taken at any other height.

11. The assembly of claim 10, wherein the first and second chills are cone shaped.

12. The assembly of claim 11, wherein the first and second chills are truncated cones including dimensions of a major diameter of more than 2.0", a minor diameter of more than 1.50" and a height of more than 1.85".

13. The assembly of claim 12, wherein the first and second chills each comprise a volume of at least ten cubic inches.

14. The assembly of claim 13, wherein the first and second chills each comprise a maximum cross section of about four square inches.

15. The assembly of claim 14, wherein the first and second chills each comprise a mass of at least 3 pounds.

16. The assembly of claim 8, wherein the chills are comprised of one or more materials selected from the group consisting of: cast steel, cast gray iron, graphite, silicon carbide and a combination thereof.

* * * * *